United States Patent [19]

Kohara

[11] Patent Number: 4,488,483

[45] Date of Patent: Dec. 18, 1984

[54] MULTICOLOR ROTARY PRINTING PRESS

[75] Inventor: Yuji Kohara, Tokyo, Japan

[73] Assignee: Kabushiki Kaisha Tokyo Kikai Seisakusho, Tokyo, Japan

[21] Appl. No.: 499,556

[22] Filed: May 31, 1983

[30] Foreign Application Priority Data

May 31, 1982 [JP] Japan ..... 57-080126[U]
May 31, 1982 [JP] Japan ..... 57-080127[U]

[51] Int. Cl.[3] ..... B41F 5/18; B41F 31/04
[52] U.S. Cl. ..... 101/178; 101/350
[58] Field of Search ..... 101/350, 363, 349, 207, 101/208, 209, 210, 178, 179, 181, 169, 157; 118/258, 259, 261

[56] References Cited

U.S. PATENT DOCUMENTS 2,112,588 3/1938 Barber ..... 101/179
4,414,897 11/1983 Sato et al. ..... 101/350

*Primary Examiner*—J. Reed Fisher

[57] ABSTRACT

There is provided a mesh roller having small recesses defined in its peripheral surface and interposed between a fountain roller for picking up ink from an ink pan and inking rollers held in contact with a plate cylinder, the fountain roller being rotatable at a peripheral speed much lower than that of the plate cylinder.

A pair of doctor blades actuatable for rotations in normal and reverse directions, respectively, is disposed in confronting relation to the mesh roller, and a means is provided for switching a system for driving the all cylinders into a normal or reverse operation mode.

6 Claims, 19 Drawing Figures

MULTICOLOR ROTARY PRINTING PRESS

BACKGROUND OF THE INVENTION

The present invention relates to a multicolor printing press capable of rotating selectively in normal and reverse directions, and more particularly to a multicolor rotary printing press having improved ink supply means respectively for two through four plate cylinders in the printing press.

Ink is required to be supplied as a layer of a few microns to a plate cylinder. To meet this requirement, a plurality of rollers (more than ten, for example) have heretofore been interposed between a plate cylinder and an ink pan for successively thinning the ink layer as it goes through the rollers until the ink layer will finally be of the above desired thickness on the plate cylinder. The group of inking rollers needs to be provided in four sets for printing in four colors, and the roller sets should be spaced apart from each other to avoid the mixing of ink mists of different colors dispelled from the inking roller groups. Therefore, these inking roller groups take up a relatively large space in the multicolor rotary printing press, making the overall press structure large in size and reducing a space available for the installation of other printing units. This has increased the cost of manufacture of the printing press. The ink mists expelled from the inking rollers tend to smear surrounding parts. In operation, the roller groups generate a great amount of noise and vibration. Accordingly, there has been a demand for improving the conventional arrangement to provide a better working environment.

SUMMARY OF THE INVENTION

It is a first object of the present invention to provide a multicolor rotary printing press which will eliminate the foregoing prior difficulties by reducing the number of inking roller groups required, so that the multicolor rotary printing press is small in size, lightweight, takes up a relatively small space, can be manufactured less costly, dispels substantially no ink mist, and gives off a reduced amount of noise and vibration.

A second object of the present invention is to provide a multicolor rotary printing press which requires no adjustment of an amount of ink supplied and an irregular ink layer supplied regardless of the reduced number of inking roller groups, resulting in a highly efficient operation with no labor and time needed for such ink adjustment.

A third object of the present invention is to provide a multicolor rotary printing press which is relatively economical due to reduced paper spoilage as the ink amount supplied and the irregular ink layer require no adjustment.

A fourth object of the present invention is to provide a multicolor rotary printing press of a small size which allows itself to be installed in the vicinity of another printing unit and be operated conveniently in association with the latter.

A fifth object of the present invention is to provide a multicolor rotary printing press capable of effecting multicolor printing on not only one surface of a web but also the other surface of the web as desired.

Briefly summarized, there is provided a mesh roller having small recesses defined in its peripheral surface and interposed between a fountain roller for picking up ink from an ink pan and an inking roller held in contact with a plate cylinder, the fountain roller being rotatable at a peripheral speed much lower than that of the plate cylinder. A pair of doctor blades actuatable for rotations in normal and reverse directions, respectively, is disposed in confronting relation to the mesh roller, and a means is provided for switching a system for driving the all cylinders into a normal or reverse operation mode.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 10 is a horizontal cross-sectional view taken along line 10—10 of FIG. 5;

DESCRIPTION OF THE PREFERRED EMBODIMENTS

Figure 1:
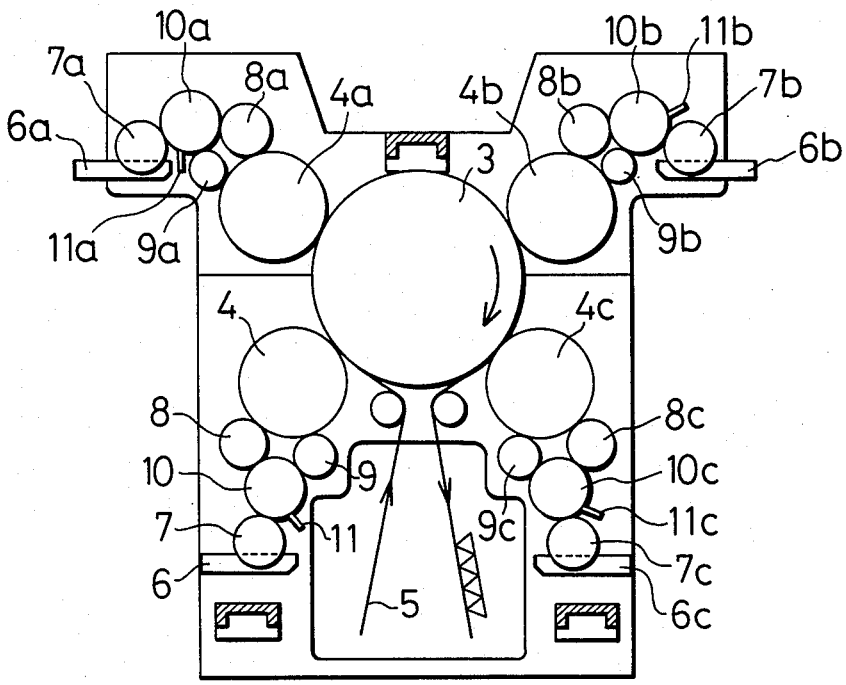
FIG. 1 is a side elevational view of a multicolor rotary printing press of the satellite type in a normal rotation.
Figure 2:
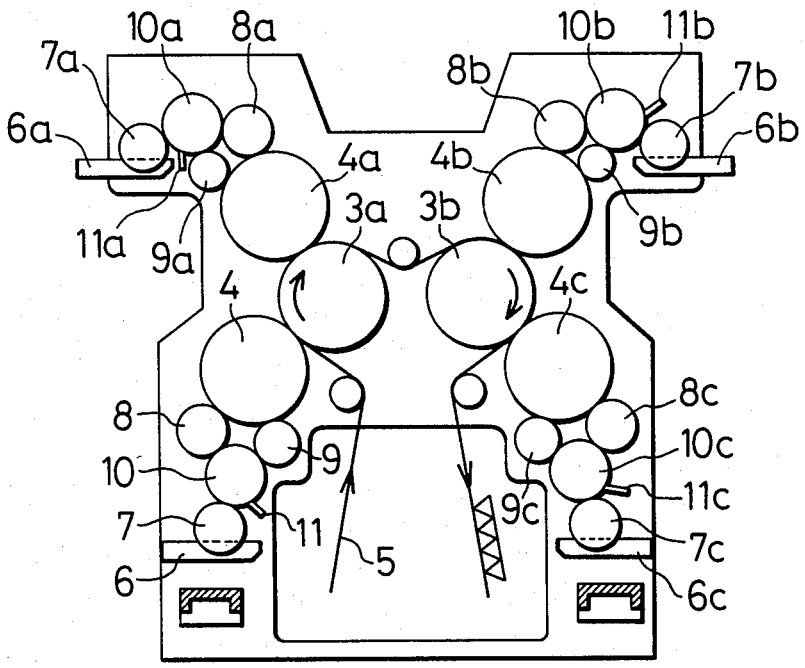
FIG. 2 is a side elevational view of a multicolor rotary printing press of the double-cylinder type in a normal rotation.

FIGS. 1 and 2 show rotary printing presses capable of four-color printing for introducing in the present invention. The printing press shown in FIG. 1 is of the satellite type including a single impression cylinder 3 and four plate cylinders 4, 4a, 4b and 4c disposed around and held in contact with the peripheral surface of the impression cylinder 3. The printing press illustrated in FIG. 2 is of the double-cylinder type comprising two impression cylinders 3a, 3b, a pair of plate cylinders 4, 4a held against the impression cylinder 3a, and a pair of plate cylinders 4b, 4c held against the impression cylinder 3b. In operation, a web 5 passes between the impression cylinder 3 and the plate cylinders 4, 4a, 4b and 4c (FIG. 1), or between the impression cylinder 3a and the plate cylinders 4, 4a and between the impression cylinder 3b and the plate cylinders 4b, 4c (FIG. 2), during which time four-color printing (indicated by four triangles) is effected on one surface of the web 5.

With the satellite type printing press, the diameter of the impression cylinder is twice that of each plate cylinder. With the double-cylinder type printing press, the impression cylinders are equal in diameter to the plate cylinders.

Inks of four different colors are supplied from respective ink pans 6, 6a, 6b and 6c to the peripheral surfaces of the plate cylinders 4, 4a, 4b and 4c, respectively. The foregoing construction is known in the art.

Conventionally, there are more than ten inking rollers have been interposed between each ink pan and the corresponding plate cylinder. However, the present invention provides only four inking rollers which are about $\frac{1}{3}$ or $\frac{1}{4}$ in number of the prior inking rollers between each ink pan and the associated plate cylinder.

Inks are picked up from the ink pans 6, 6a, 6b and 6c by fountain rollers 7, 7a, 7b and 7c which are rotated by a drive system (not shown) at a peripheral speed much lower than that of rotation of the plate cylinders 4, 4a, 4b and 4c. When the inks are taken out of the ink pans, the inks contained therein are subjected to smaller waves on their surfaces due to the smaller rotational speed of the fountain rollers, with the results that air bubbles will be prevented from entering the inks and ink mists will be reduced to a minimum which would otherwise be dispelled by such air bubbles.

The ratio of the rotational speed of the fountain rollers to that of the plate cylinders varies with the speed of operation of the printing press. For substantially preventing ink mist formation, the speed reduction ratio is about 1/10 for a low-speed printing press, about 1/20 for a medium-speed printing press, and about 1/30 through 1/40 for a high-speed or ultra-high-speed printing press.

Pairs of inking rollers 8, 9; 8a, 9a; 8b, 9b; and 8c, 9c are held in contact with the plate cylinders 4, 4a, 4b and 4c, respectively, for supplying inks to the latter. Mesh rollers 10, 10a, 10b and 10c are held in contact with the pairs of inking rollers 8, 9; 8a, 9a; 8b, 9b; and 8c, 9c, respectively, and rotatable at the same peripheral speed as that of the plate cylinders. The mesh rollers 10, 10a, 10b and 10c are spaced slight distances from the fountain rollers 7, 7a, 7b and 7c, respectively. Each mesh roller has a peripheral surface made of special steel and engraved with a mesh-like pattern of minute recesses such as of a 250 mesh, the engraved peripheral surface being coated with a plated layer of chromium for increased resistance to wear.

There are provided doctor blades 11, 11a, 11b and 11c having distal ends pressed against the peripheral surfaces of the mesh rollers 10, 10a, 10b and 10c, respectively, immediately downstream of positions in which the mesh rollers are placed adjacent to the fountain rollers. The doctor blades 11, 11a, 11b and 11c are oriented at reverse angles, that is, in a direction opposite to the direction of rotation of the mesh rollers 10, 10a, 10b and 10c, respectively. The ink transferred to the mesh rollers is scraped off therefrom by the doctor blades except for those ink layers which are trapped in the recesses in the mesh rollers, the scraped ink being returned to the ink pans. Since any excessive ink is not allowed to be fed along, therefore, the rollers positioned downstream of the mesh rollers will not scatter ink mists around.

The ink layers trapped in the recesses in the mesh rollers are permitted to be supplied to the plate cylinders through the inking rollers 8, 9; 8a, 9a; 8b, 9b and 8c and 9c.

The ink which has reached the plate cylinders is extended by the coaction of the mesh rollers and the doctor blades into a uniform coating having a constant thickness, so that the plate cylinders are supplied with an optimum amount of ink at all times.

With the arrangement of the mesh rollers, many ink distributing rollers and ink extending rollers which have been required by the conventional printing presses are no longer necessary, and the number of inking rollers needed is only about $\frac{1}{3}$ through $\frac{1}{4}$ of that of prior inking rollers.

In FIG. 1, the diameter of the impression cylinder is twice that of the plate cylinders, and in the embodiment of FIG. 2, the diameter of the impression cylinders is the same as that of the plate cylinders. All of the cylinders used, including the impression and plate cylinders, are single continuous cylinders extending between and supported on opposite side frames of the printing press.

Printing presses according to the present invention will be described with reference to FIGS. 3 and 4.

A pair of doctor blades B, C is disposed in symmetrical locations one on each side of a central position in which each mesh roller is placed adjacent to the corresponding fountain roller, the doctor blades having distal ends held against the peripheral surface of the mesh roller.

As shown in FIGS. 5 through 15, each of the doctor blades is individually displaceable through an angular interval between a position in which the doctor blade is pressed against the mesh roller and a position in which the doctor blade is spaced from the mesh roller. Such an operation will be described later in detail.

One of the doctor blades which is pressed against the mesh roller has a bearing on the direction of rotation of the mesh roller. When the mesh roller rotates clockwise (hereinafter referred to as "normal rotation"), the doctor blade B, shown lefthand, is pressed against the mesh roller and the doctor blade C, shown righthand, is retracted out of contact with the mesh roller. When the mesh roller rotates counterclockwise (hereinafter referred to as "reverse rotation"), the righthand doctor blade C is pressed against the mesh roller, and the lefthand doctor blade B is spaced from the mesh roller. Therefore, the doctor blade as oriented at a reverse angle, that is, in a direction opposite to the direction of rotation of the mesh roller, is pressed against the peripheral surface thereof, and the other doctor blade as oriented in a forward direction is spaced from the mesh roller.

The ink transferred to the mesh roller is scraped off therefrom by the doctor blade contacting the mesh roller in a direction against its rotation except for those ink layers which are trapped in the recesses in the mesh rollers, the scraped ink being returned to the ink pans. Since any excessive ink is not allowed to be fed along, therefore, the rollers positioned downstream of the mesh rollers will not scatter ink mists around.

The ink layes trapped in the recesses in the mesh rollers are permitted to be supplied to the plate cylinders through the inking rollers 8, 9; 8*a*, 9*a*; 8*b*, 9*b* and 8*c* and 9*c*.

The ink which has reached the plate cylinders is extended by the coaction of the mesh rollers and the doctor blades into a uniform coating having a constant thickness, so that the plate cylinders are supplied with an optimum amount of ink at all times.

With the foregoing arrangement, many ink distributing rollers and ink extending rollers which have been required by the conventional printing presses are no longer necessary, and the number of inking rollers needed is only about $\frac{1}{3}$ through $\frac{1}{4}$ of that of prior inking rollers.

Figure 3:
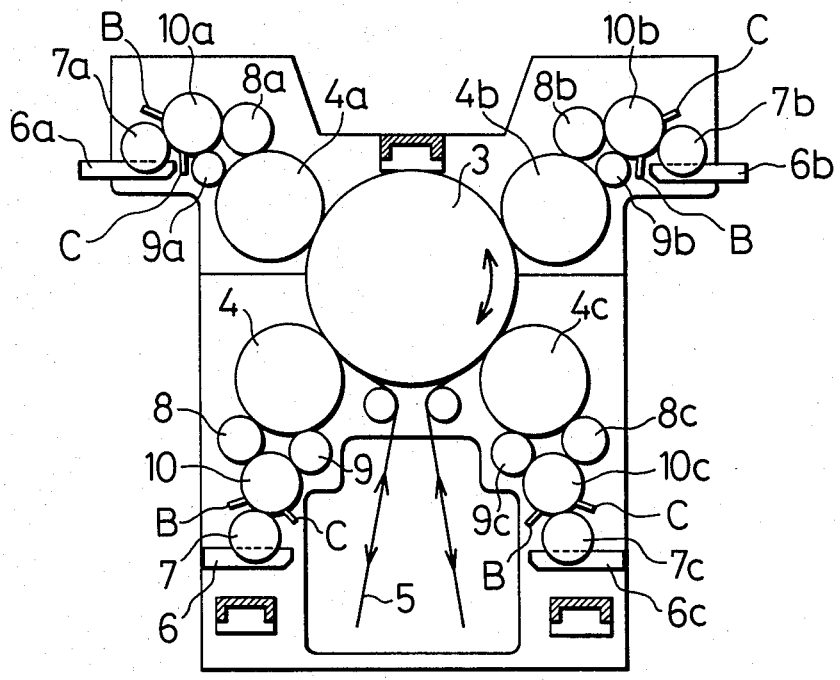
FIG. 3 is a side elevational view of a reverse rotatable multicolor rotary printing press of the satellite type according to a first embodiment of the present invention.
Figure 4:
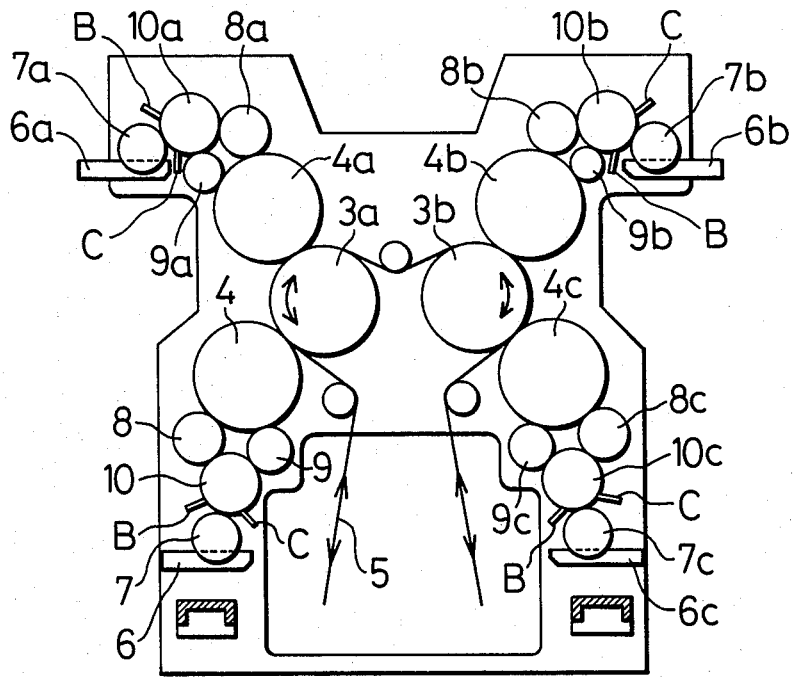
FIG. 4 is a side elevational view of a reverse rotatable multicolor rotary printing press of the double-cylinder type according to a second embodiment of the present invention.

In the embodiment of FIG. 3, the diameter of the impression cylinder is twice that of the plate cylinders, and in the embodiment of FIG. 4, the diameter of the impression cylinders is the same as that of the plate cylinders. All of the cylinders used, including the impression and plate cylinders, are single continuous cylinders extending between and supported on opposite side frames of the printing press.

FIGS. 5 through 15 illustrate a means for bringing the righthand and lefthand doctor blades B, C into and out of contact with the peripheral surface of the mesh roller 10.

Figure 11:
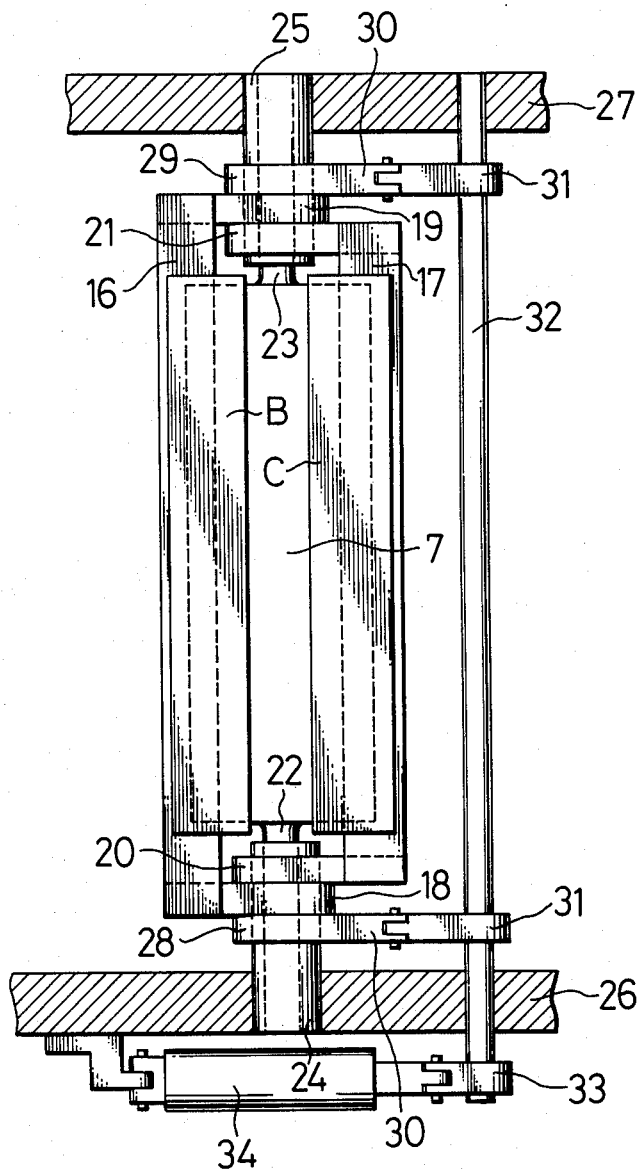
FIG. 11 is a a horizontal cross-sectional view taken along line 11—11 of FIG. 6.

The doctor blades B, C are fixed respectively to mount bases 16, 17 having opposite ends securely supported on distal ends of support arms 18, 19, 20 and 21, as shown in FIG. 11. Each of the support arms has an annular proximal portion fitted rotatably over the peripheral surfaces of eccentric sleeves 24, 25 that carry therein opposite shafts 22, 23 of the fountain roller 7. The fountain roller 7 is supported by the eccentric sleeves 24, 25 by side frames 26, 27.

Figure 12:
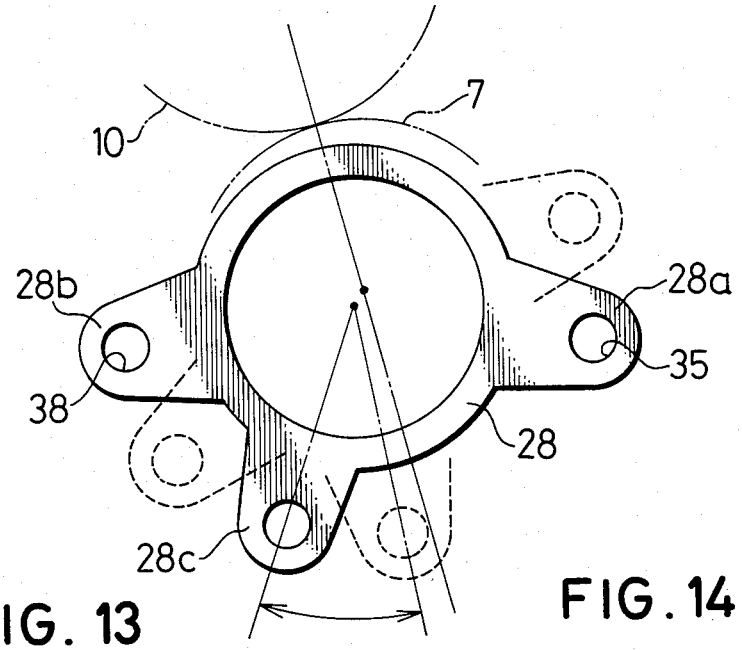
FIG. 12 is a front elevational view of a trifurcate arm for switching between normal and reverse rotations.
Figure 13:
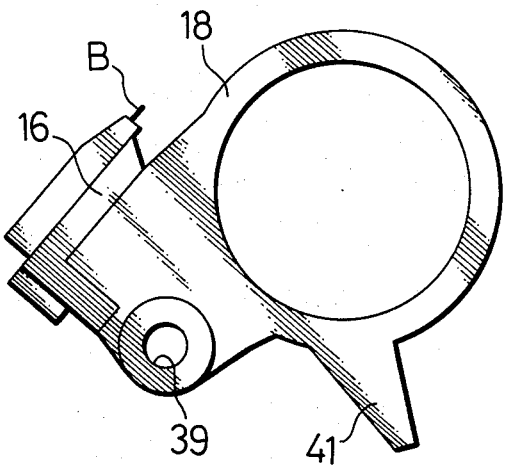
FIG. 13 is a front elevational view of a support arm for the lefthand doctor blade for normal rotation.
Figure 14:
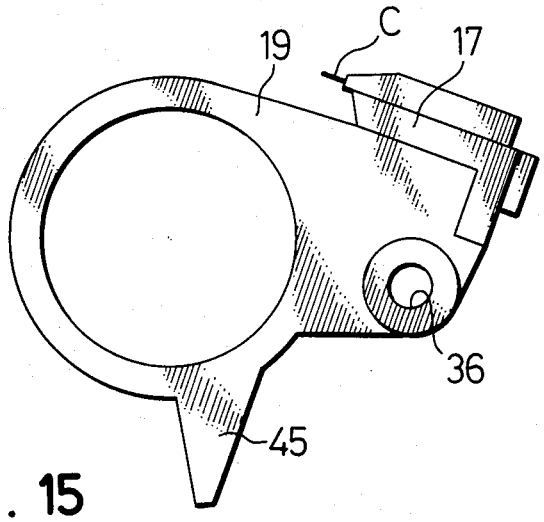
FIG. 14 is a front elevational view of a support arm for the righthand doctor blade for reverse rotation.

Third or trifurcate arms 28, 29 have annular proximal end portions fittted over the eccentric sleeves 24, 25. As shown in FIG. 12, each of the trifurcate arms 28, 29 has three arms extending radially outwardly from the proximal end portion thereof, the arms including a righthand blade actuator arm 28*a*, a lefthand blade actuator arm 28*b*, and a displacement transmitting arm 28*c*. The displacement transmitting arm 28*c* is coupled through a link 30 and an arm 31 to a cross shaft 32 which is coupled through an arm 33 at one end thereof to a single actuator 34 such as a pneumatic cylinder. Therefore, the displacement transmitting arm 28*c* is angularly movable reciprocably in response to reciprocating displacement of the cylinder 34.

The arms 18, 20, 28; 19, 21, 29 juxtaposed on the eccentric sleeves 24, 25, respectively, may be arranged in any desired order. In an embodiment shown in FIGS. 9 through 11, the trifurcate arms 28, 29 are positioned outwardly of the other arms, while in an embodiment of FIGS. 5 through 8, the trifurcate arm 28 is positioned inwardly of the other arms. The requirement is that the displacement from the single actuator 34 be transmitted through the trifurcate arms 28, 29 to the lefthand blade support arms 18, 19 when the mesh roller 10 is to rotate clockwise or to the righthand blade support arms 20, 21 when the mesh roller 10 is to rotate counterclockwise, through switching operation of a clutch which comprises a pin clutch mechanism according to the illustrated embodiment.

The support arm 20 for the righthand doctor blade C and the righthand blade actuator arm 28*a* of the trifurcate arm are interconnected by a pin 37 inserted in holes 35, 36 defined in distal ends of the arms 20, 28*b*. The supported arm 20 and the righthand blade actuator arm 28*a* can be disconnected by retracting the pin 37 into one of these holes 35, 36 out of the other.

The support arm 18 for the lefthand doctor blade B and the lefthand blade actuator arm 28*b* of the trifurcate arm are interconnected by a pin 40 inserted in holes 38, 39 defined in distal ends of the arms 20, 28*b*. The support arm 18 and the lefthand blade actuator arm 28*b* can be disconnected by retracting the pin 40 into one of these holes 38, 39 out of the other.

While in the illustrated embodiment the pin clutch mechanism that is easily manually actuatable is shown, the pin can automatically actuated electromagnetically.

Figure 5:
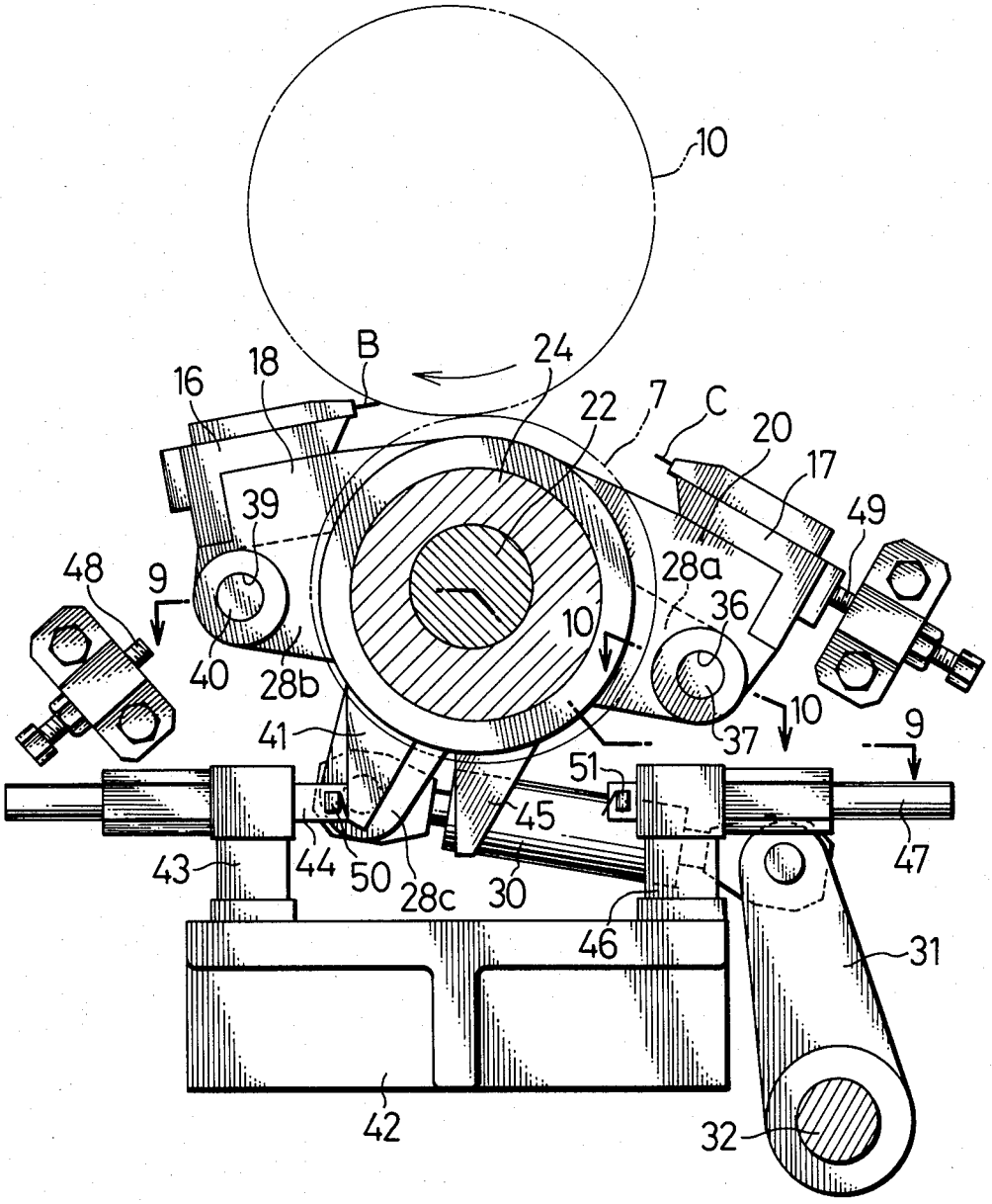
FIG. 5 is a vertical cross-sectional view taken along line A—A of FIG. 9, showing another embodiment in which a pair of doctor blades are individually displaceable, the lefthand doctor blade for normal rotation being shown in contact with a mesh roller rotating in a normal direction.
Figure 6:
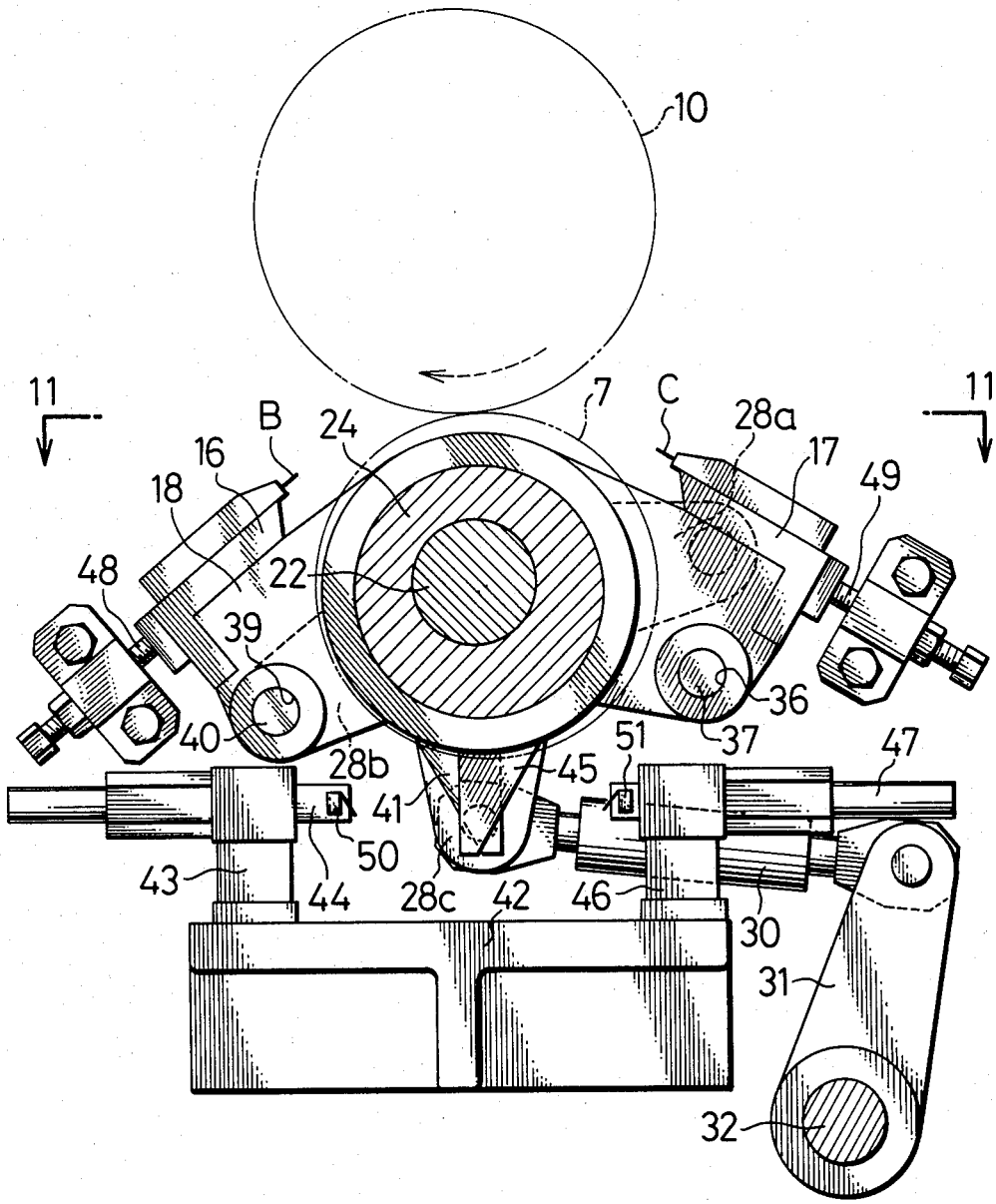
FIG. 6 is a view similar to FIG. 5, showing a clutch pin actuated for the lefthand doctor blade with respect to the mesh roller which has been switched for rotation in the normal rotation.

FIG. 6 shows the position in which the arms 18, 28*b* are interconnected by the lefthand pin 40. When the interconnection between the arms 18, 28*b* is completed, the pneumatic cylinder 34 is actuated to cause the arm 33, the cross shaft 32, the arm 31 and the link 30 to angularly displace the displacement transmitting arm 28*c* to the left. Then, as shown in FIG. 5, the lefthand doctor blade B is brought into contact with the peripheral surface of the mesh roller 10, whereupon ink can be scraped off during the normal rotation of the mesh roller 10.

Figure 7:
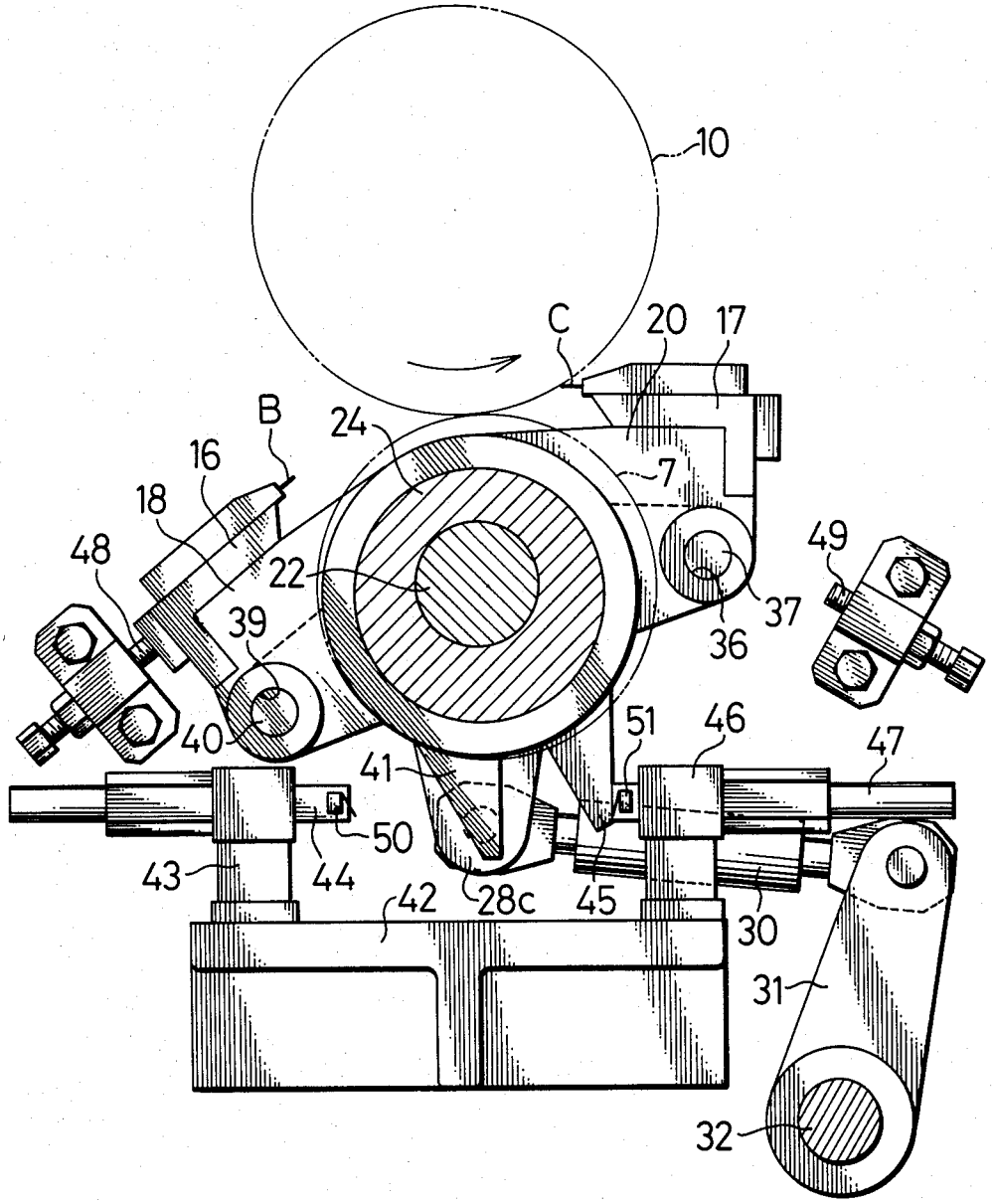
FIG. 7. is a view similar to FIG. 5, showing the righthand doctor blade for reverse rotation in contact with the mesh roller rotating in a reverse direction.
Figure 8:
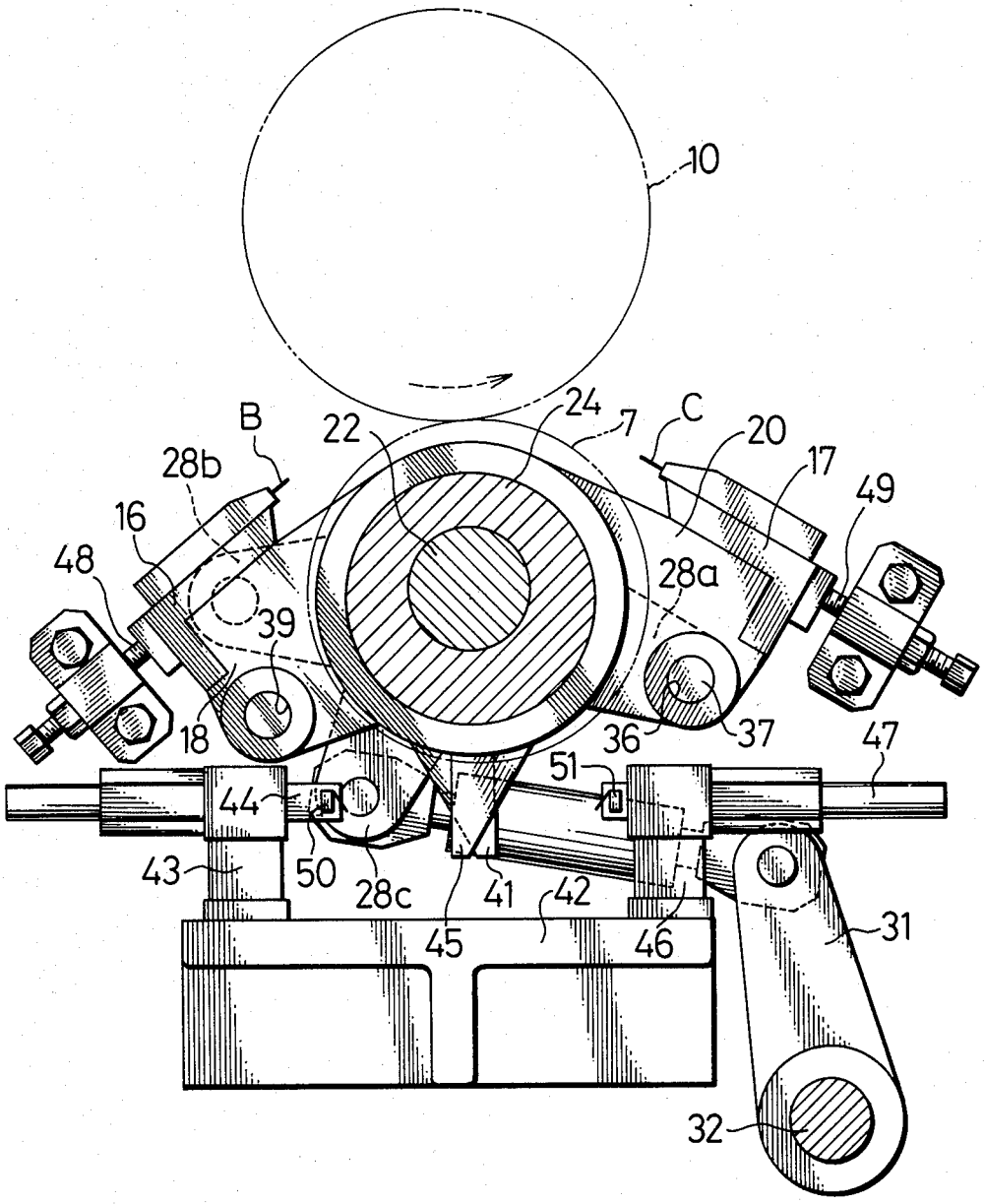
FIG. 8 is a view similar to FIG. 5, illustrating a clutch pin actuated for the righthand doctor blade with respect to the mesh roller which has been switched for rotation in the reverse direction.
Figure 9:
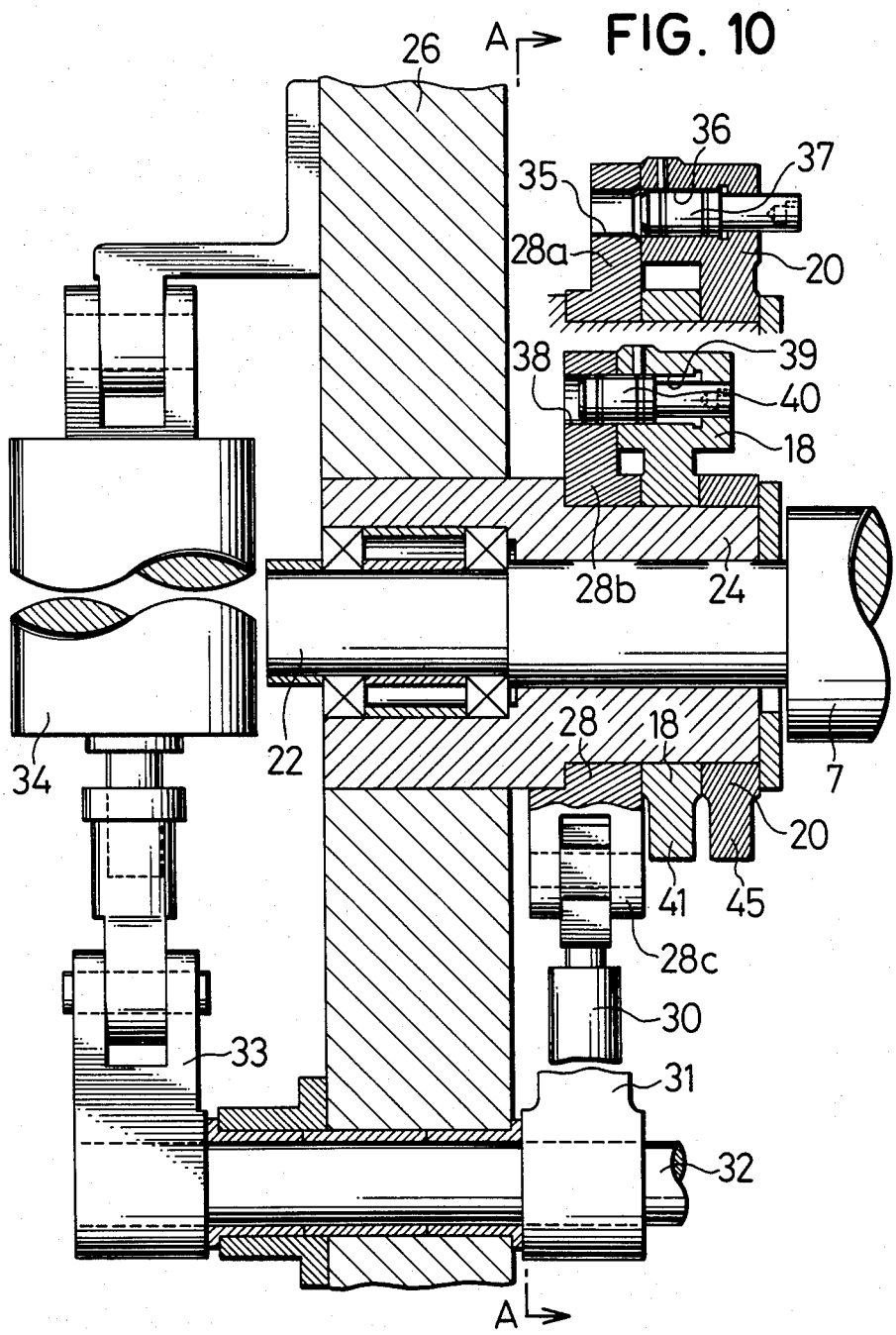
FIG. 9 is a horizontal cross-sectional view taken along line 9—9 of FIG. 5.

FIG. 8 illustrates the position in which the arms 20, 28*a* are interconnected by the lefthand pin 37. When the interconnection between the arms 20, 28*a* is completed, the pneumatic cylinder 34 is actuated to angularly displace the displacement transmitting arm 28*c* to the right. Then, as shown in FIG. 7, the righthand doctor blade C is brought into contact with the peripheral surface of the mesh roller 10, whereupon ink can be scraped off during the reverse rotation of the mesh roller 10.

The lefthand blade support arm 18 has a downwardly projecting finger 41 for adjusting the pressure of contact of the doctor blade B against the mesh roller 10. The finger 41 abuts against the distal end of an adjustment screw rod 44 threaded through a bracket 43 mounted on a bae 42. The angular position in which the finger 41 is held at rest can be adjusted by displacing the screw rod 44 back and forth, so that the lefthand doctor blade B is pressed against the mesh roller 10 under an adjusted pressure. Likewise, the righthand blade support arm 20 has a downwardly projecting finger 45 for adjusting the pressure of contact of the doctor blade C against the mesh roller 10. The finger 45 is positionally adjustable by displacing an adjustment screw rod 47 threaded through a bracket 46 on the base 42 for varying the pressure of contact with which the righthand doctor blade C is held against the mesh roller 10.

The pin holes in the blade support arms 18, 20 are adjustable for alignment by lefthand and righthand stops 48, 49. Through fine adjustment of the stops 48, 49, the holes 39, 36 in the arms 18, 29 are brought into registry with the holes 38, 35, respectively, in the trifurcate arm 28.

The righthand pin clutch is actuatable in FIGS. 5 and 8, and the lefthand pin clutch is actuatable in FIGS. 6 and 7. The pins 40, 37 are in their connecting positions respectively on the lefthand blade support arm 18 of FIG. 5 and the righthand blade support arm 20 of FIG. 7. The pins 37, 40 are in their disconnecting positions respectively on the righthand blade support arm 20 of FIG. 6 and the lefthand blade support arm 18 of FIG. 8.

If the pairs of arms 10, 28*a* and 18, 28*b* connectable by the pins 37, 40 were integrally constructed, the doctor blades could easily be cleaned, replaced or inspected since when one arm pair is actuated, the other arm pair is always lowered to the retracted position. However, it is preferred that both the doctor blades B, C be spaced from the periphery of the mesh roller 10 for inspecting, maintaining and replacing the mesh roller 10 or adjusting the pressure of contact against the fountain roller. To meet this requirement, the arms should be disconnectable by withdrawal of the pins as shown in FIGS. 6 and 8.

If the doctor blades B, C were angularly spaced from each other by a constant angular interval at all times, then it would be impossible to effect individual adjustment of the pressure of contact of the doctor blades against the mesh roller 10, with a resulting failure in smooth operation to scrape ink off the mesh roller 10. Therefore, the support arms are provided respectively for the support arms so that the doctor blades can separately be adjusted in angular positions thereof and their pressures of contact against the mesh roller can independently be changed.

The foregoing construction allows ink to be scraped off the mesh roller effectively provided the operating procedure is proper. However, when the wrong doctor blade is brought into contact with the mesh roller, or when the printing unit is operated while both the doctor blades are out of contact with the mesh roller, through an erroneous operating process, no ink can be scraped off, and a large amount of ink is supplied to the plate cylinders to thereby blacken the print paper with the ink. The large amount of ink applied to the print paper causes the paper to stick around a guide roller or a folding cylinder, or is scattered around to smear surroundings.

Figure 15:
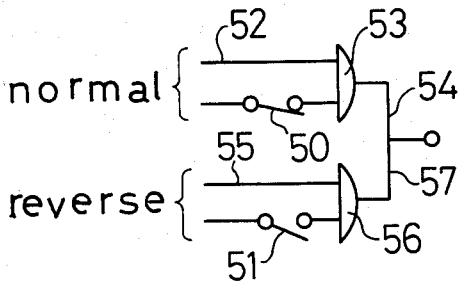
FIG. 15 is a circuit diagram for a safety circuit for protection against erroneous switching operation.

A safety circuit for protection against the above troubles is illustrated in FIG. 15. The safety circuit has a pair of limit switches 50, 51 (FIGS. 5 through 8 and 15) for detecting the lefthand doctor blade B and the righthand doctor blade C in their positions in which they contact the periphery of the mesh roller 10 and are readied for scraping ink off the mesh roller 10. The limit switches 50, 51 are positioned in alignment with the distal ends of the screw rods or stops 44, 47 which the fingers 41, 45 engage, respectively. When the lefthand doctor blade B is in the operated position, the lefthand limit switch 50 is closed to issue a signal. Since the righthand limit switch 51 is open at this time, it produces no signal. When the righthand doctor blade C is actuated, the righthand limit switch 51 is closed to generate a signal, but the lefthand limit switch 50 fails to issue any signal.

A power switching clutch (not shown) can produces a signal indicative of a normal rotation mode of a gear train (not shown) for driving all of the cylinders including the plate cylinders and the impression cylinder, and another signal indicative of a reverse rotation mode of such a gear train.

As illustrated in FIG. 15, the safety circuit also includes an AND gate 53 for producing a drive command signal 54 when it is supplied with an output signal from the limit switch 50 as it detects the lefthand doctor blade B in the actuated position and a signal 52 representative of the normal rotation mode of the gear train, and an AND gate 56 for producing a drive command signal 57 when it is supplied with an output signal from the limit switch 51 as it detects the righthand doctor blade C in the actuated position and a signal 55 representative of the reverse rotation mode of the gear train. The safety circuit allows the rotary printing press to be started only when the drive command signal 54 or 57. Therefore, the foregoing troubles are eliminated by the safety circuit since the rotary printing press is not driven unless the above drive command signal is applied.

With the arrangement of the present invention, the fountain rollers 7, 7*a*, 7*b* and 7*c* and the mesh rollers 10, 10*a*, 10*b* and 10*c* are spaced small distances from each other, and the fountain rollers are rotated at a much lower peripheral speed than that of the plate cylinders. This prevents ink mists from being given off from the ink pans. The ink from the fountain rollers is supplied to the mesh rollers having small recesses in their peripheral surfaces, and any excessive ink except ink layers trapped in the recesses in the mesh rollers can be scraped off the latter back into the ink pans by the doctor blades B, C disposed immediately downstream of positions in which the mesh rollers are placed adjacent to the fountain rollers and held against the mesh rollers in an orientation opposite to the direction of roataion of the mesh rollers. The rollers positioned downstream of the mesh rollers do not produce ink mists which would otherwise be created by excessive ink supplied from the mesh rollers. Since only the ink layers trapped in the recesses in the peripheries of the mesh rollers are supplied to the inking rollers 8, 9; 8*a*, 9*a*; 8*b*, 9*b* and 8*c*, 9*c*, the ink coatings on the plate cylinders are extended uniformly in a constant thickness, and hence no excessive amount of ink is applied to the plate cylinders. The foregoing inking system is constructed of inking cylinders which are about $\frac{1}{3}$ through $\frac{1}{4}$ in number of the conventional inking cylinders. Accordingly, the overall printing press is small in size, lightweight, can be constructed less costly, and can reduce noise and vibration during operation for a better working environment therearound. No adjustment is required of the amount of ink supplied and irregular ink layers applied. The rotary printing press can therefore be operated more simply and speedily without requiring much skill on the part of the operator, and is economical as it reduces paper spoilage.

Figure 16:
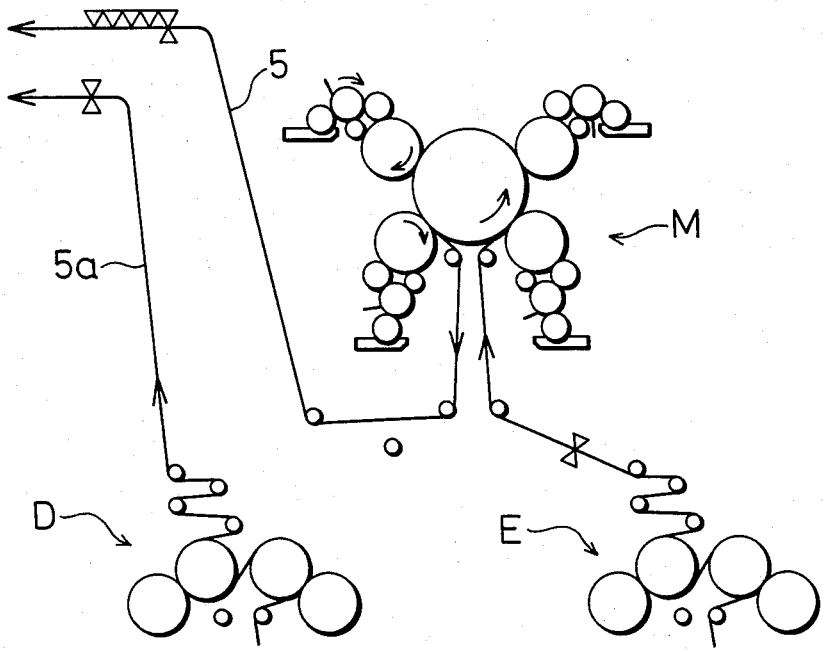
FIGS. 16 through 19 are schematic diagrams showing a path of travel of print paper comprising four pages composed of two webs while cylinders are switched for normal and reverse rotation, FIG. 16 being illustrative of multicolor printing on the first page, FIG. 17 of multicolor printing on the second page, FIG. 18 of multicolor printing on the third page, and FIG. 19 of multicolor printing on the fourth page.
Figure 17:
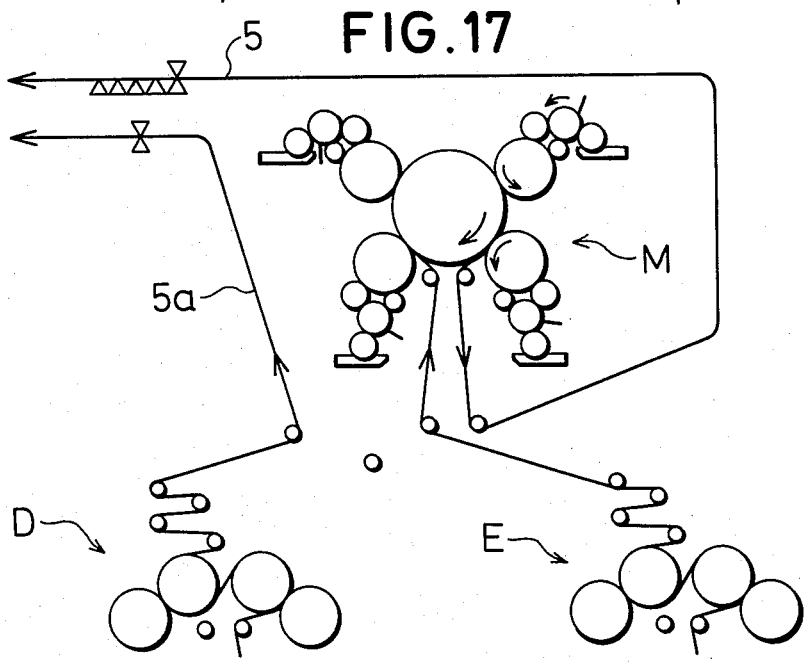
Figure 18:
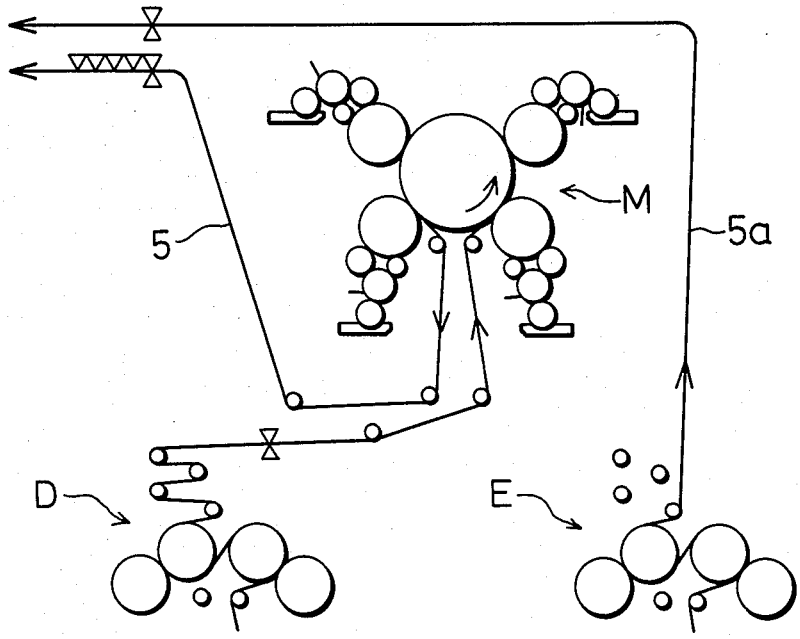
Figure 19:
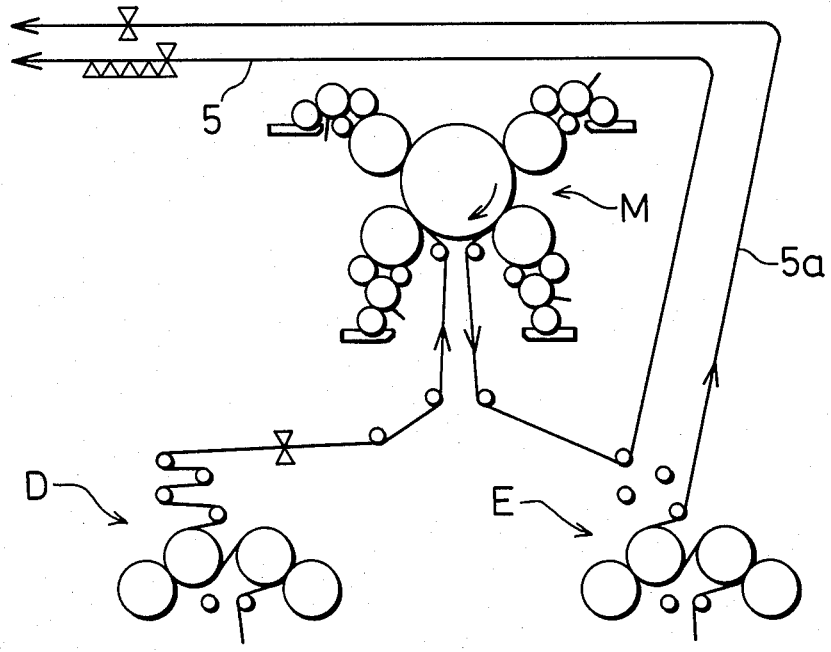

FIGS. 16 through 18 illustrate a multicolor rotary printing press M of a small size having an inking system according to the present invention, and other printing units D, E positioned closely to the printing press M. The printing press M and the printing units D, E can be operated easily to effect cooperative printing thereon. By associating selective clutch operation for the doctor blades B, C with switching clutch operation for the gear train to rotate in the normal or reverse direction for driving the cylinders in the printing press M, multicolor printing can be performed on not only one surface of the web 5 (FIGS. 17 and 19), but also the other surface thereof (FIGS. 16 and 18). In FIGS. 16 through 18, one triangle shown along the webs 5 and 5*a* is indicative of printing in one color only. Any desired page of printing paper comprising four pages composed of the webs 5, 5*a* can be printed in multiple colors. For example, FIG. 16 shows multicolor printing on the first page, FIG. 17 such printing on the second page, FIG. 18 the printing on the third page, and FIG. 19 the printing on the fourth page.

Although certain preferred embodiments have been shown and described, it should be understood that many changes and modifications may be made therein without departing from the scope of the appended claims.

What is claimed is:

1. A multicolor rotary printing press rotatable selectively in a normal or reverse direction comprising:

(a) a single impression cylinder;

(b) a plurality of plate cylinders disposed around and held against said single impression cylinder for passing a web of print paper successively between said impression cylinder and said plate cylinders to effect multicolor printing on said web; and (c) ink supply means associated respectively with said plate cylinders, each of said ink supply means including:

(1) a fountain roller rotatable at a peripheral speed lower than a peripheral speed of said plate cylinder for picking up ink from an ink pan;

(2) inking rollers held in contact with said plate cylinder for supplying ink to said plate cylinder;

(3) a mesh roller held against said inking rollers and rotatable at the same peripheral speed as that of said plate cylinder, said mesh roller being spaced slightly from said fountain roller and having minute recesses defined in a peripheral surface thereof;

(4) a pair of first and second doctor blades disposed in symmetrical locations one on each side of a position in which said mesh roller is disposed adjacent to said fountain roller, and having distal ends confronting and pressable against said mesh roller;

(5) switch means for independently displacing said doctor blades between a first position in which said doctor blades are pressed against said mesh roller and a second position in which said doctor blades are spaced from said mesh roller;

(6) a system for driving all of said cylinders in the normal or reverse direction; and (7) clutch means for switching said system to rotate said cylinders selectively in the normal or reverse direction.

2. A multicolor rotary printing press according to claim 1, wherein said impression cylinder has a diameter twice larger than that of said plate cylinders, each said impression and plate cylinders comprising a single continuous cylinder.

3. A multicolor rotary printing press according to claim 1, wherein said impression cylinder has a diameter equal to that of said plate cylinders, each said impression and plate cylinders comprising a single continuous cylinder.

4. A multicolor rotary printing press according to claim 1, wherein said fountain roller has a pair of axial opposite shafts, said switch means comprising a pair of mount bases on which said doctor blades are supported, respectively, a pair of eccentric sleeves carrying said axial opposite shafts therein, two pairs of first and second blade support arms having distal ends supporting said mount bases at ends thereof and annular proximal portions rotatably fitted over said eccentric sleeves, a pair of trifurcate arms for switching between rotations in the normal and reverse directions, each of said trifurcate arms being composed of an annular proximal portion rotatably fitted over one of said eccentric sleeves, a first-doctor-blade actuator arm projecting radially outwardly from said annular proximal portion, a second-doctor-blade actuator arm projecting radially outwardly from said annular proximal portion, and a displacement transmitting arm projecting radially outwardly from said annular proximal portion, a single actuator connected through a linkage to said displacement transmitting arm for angularly moving the latter through a predetermined angular interval, a first clutch mechanism for connecting and disconnecting said first blade support arms and said first-doctor-blade actuator arm, a second clutch mechanism for connecting and disconnecting said second blade support arms and said second-doctor-blade actuator arm, and a safety circuit having a first detector for producing a first output signal indicative of a condition in which said second doctor blade is in said first position and a second detector for producing a second output signal indicative of a condition in which said first doctor blade is in said second position, said safety circuit being energizable to enable said driving system to operate either when said safety circuit is supplied with both said first output signal and a signal representative of a normal rotation mode of a gear train in said driving system, or when said safety circuit is supplied with both said second output signal and a signal representative of a reverse rotation mode of said gear train.

5. A multicolor rotary printing press according to claim 1, wherein said peripheral speed of said fountain roller is in the range of from 1/10 to 1/40 of the peripheral speed of said plate cylinder.

6. A multicolor rotary printing press according to any one of claims 2 or 3, wherein the plate cylinder has peripheral length corresponding to two pages of printing paper.

* * * * *